United States Patent [19]

Rusch

[11] 4,173,667

[45] Nov. 6, 1979

[54] CHRISTMAS ORNAMENT AND KIT FOR MAKING THE SAME

[76] Inventor: William C. Rusch, Bow Lane R.R. 2, Barrington Hills, Ill. 60010

[21] Appl. No.: 791,924

[22] Filed: Apr. 28, 1977

[51] Int. Cl.[2] ..... A47G 33/08

[52] U.S. Cl. ..... 428/11; 29/463; 40/594; 40/617; 428/14; 428/33; 428/35; 428/40; D11/121

[58] Field of Search ..... 428/11, 33, 34, 35, 428/13, 14, 40; 40/1.5, 158 R, 152, 128, 594, 617; 63/18; D9/181; D11/121; D96/12 J; 229/92.8; 206/575; 29/463, 467, 469

[56] References Cited

U.S. PATENT DOCUMENTS

| | | | |
|---|---|---|---|
| 1,699,105 | 1/1929 | Friedman | 40/617 |
| 1,709,041 | 4/1929 | Schutt | 40/617 |
| 1,817,064 | 8/1931 | Carson | 40/617 |
| 2,639,254 | 5/1953 | Smith | 40/152 |
| 3,283,431 | 11/1966 | Pearlman | 40/152 |
| 3,440,128 | 4/1969 | Kubilius | 428/11 |
| 3,635,783 | 1/1972 | Rimmler | 428/11 |
| 3,694,648 | 9/1972 | Yates | 428/11 |
| 3,713,238 | 1/1973 | Hyman et al. | 229/92.8 |
| 3,847,325 | 11/1974 | Nasalski et al. | 229/92.8 |

FOREIGN PATENT DOCUMENTS

| | | | |
|---|---|---|---|
| 1404803 | 12/1960 | Fed. Rep. of Germany | 428/11 |
| 1241317 | 1/1965 | Fed. Rep. of Germany | 428/11 |

OTHER PUBLICATIONS

Hobby/Crafts Kits, Handkraft Corp., Chicago, Ill., (1970), p. 15.

*Primary Examiner*—Jerome W. Massie

*Attorney, Agent, or Firm*—Wallenstein, Spangenberg, Hattis & Strampel

[57] ABSTRACT

A kit for making an ornament which can be supported on a stand or hung from a Christmas tree or the like includes a pair of transparent preferably hemispherical hollow housing-forming members lockable into confronting relation to form a transparent housing with a vertical line of juncture therebetween to provide an unobstructed view into the housing from opposite sides thereof. The housing-forming members have complimentary confronting narrow neck-forming portions between which a tiny hand rod can be mounted. A hook-receiving cap member is provided which frictionally fits over the neck-forming portions of the housing-forming members to lock the same together. The kit also includes an ornamental article or articles to be mounted in a predetermined position initially in one of the members before the other member is fitted thereover. The ornamental article may be a greeting card supportable in a vertical position by hanging the same on the hang rod. The greeting card is formed from a greeting card blank forming part of the kit and having a pressure sensitive adhesive on one side covered by a removable backing sheet. The kit further includes a template to trace a line on a suitable photograph to be trimmed along the line so the photograph fits on the pressure sensitive side of the greeting card. An annular Christmas wreath border-forming element and ornamental braid are also incorporated in the kit respectively for ornamenting and covering the margins of the photograph supported on the greeting card and for covering the juncture line between the housing-forming members.

12 Claims, 31 Drawing Figures

CHRISTMAS ORNAMENT AND KIT FOR MAKING THE SAME

BACKGROUND OF THE INVENTION

The present invention relates to ornamental articles, such as Christmas tree ornaments or the like, which comprise a wholly or partially transparent housing, preferably a hollow ball-shaped housing, containing one or a number of ornamental objects visible through one or more walls of the housing.

U.S. Pat. No. 3,440,128 to Kubilius discloses such a Christmas ornament having a hollow ball-shaped housing formed by an opaque hollow hemispherical housing member and a transparent hollow hemispherical housing member held together by prongs or the like in confronting relation along a vertical juncture plane. The opaque housing member contains a putty-like body which holds a vertically oriented photograph visible through the transparent housing member. One of the objects of the present invention is to provide a personalized Christmas ornament and a kit for making the same which has a greater attractiveness and appeal than that shown in U.S. Pat. No. 3,440,128.

Other examples of Christmas ornaments or the like having a transparent housing in which one or more ornamental objects are mounted is shown in French Pat. No. 1,191,427, granted Oct. 20, 1959, West German Pat. No. 937,008, granted Dec. 29, 1955, and West German Pat. No. 850,793 granted Sept. 29, 1952. The ornamental articles disclosed in the German patents are Christmas tree ornaments with transparent ball-shaped housings with ornamental objects supported by the bottom or upper extremities of the housing. The ornament disclosed in the French patent has a transparent cylindrical-shaped housing supported on a horizontal support surface and contains an ornamental figurine and background scene. Another object of the invention is to provide an ornamental article and a kit for making the same where the ornament has a housing preferably of a ball-like configuration and containing a photograph, figurines or the like, can serve as a Christmas tree hung ornament or one supported on a horizontal support surface, and constitutes an improvement over the ornamental articles disclosed in all of said patents in that it forms a more attractive ornamental article and/or can be more quickly and easily assembled from inexpensive kit-forming parts into a rugged attractive ornament.

SUMMARY OF THE INVENTION

In accordance with one of the features of the present invention, a kit for making a personalized ornament is provided of the type including a hollow transparent housing, preferably of spherical or ball-like configuration, and which can be easily assembled from a pair of housing-forming members confrontable along a vertical plane. The housing is designed to support in a vertical position a personalized greeting card so that a full unobstructed view is obtained of opposite sides of the greeting card through the housing walls. The greeting card most advantageously is made from a greeting card blank which preferably includes on one side thereof indicia like "Season's Greetings from" adjacent to which the name of the sender of the card can be written with a pen or the like. The marginal portion of this side of the card may contain, for example, an attractive Christmas wreath design which frames the "Season's Greetings from" portion of the card. The other side of the blank includes a pressure-sensitive adhesive layer cover by a pealable backing sheet. The kit may further include an annular decorative border-forming unit forming a Christmas wreath or the like and having a pressure-sensitive adhesive on the rear side thereof covered by a pealable backing sheet. Additionally, the kit may include a template to trace a line on a suitable photograph to be trimmed along the line, so that the photograph fits the pressure sensitive side of the greeting card blank, and an ornamental tape or braid for application over the lines of juncture between the housing-forming members.

From the kit just described, the user may form an ornamental greeting card for the housing by cutting to the desired size a photograph of the person giving the ornament as a gift or greeting. Thus, a tracing line is formed on the photograph by running a pencil along the border of the template, and the photograph is cut along this line and then applied to the exposed pressure sensitive adhesive on the greeting card blank. The marginal portion of the photograph is then ornamented by said Christmas wreath border-forming element applied thereto. After signing the "Season's Greetings from" side of the greeting card blank, the completed greeting card is mounted vertically within one of the transparent housing-forming members, as by hanging the same on a rod at the top of the housing member so that each side of the greeting card can be visible without obstruction from the sides of the completed housing on opposite sides of the housing juncture plane. The other housing-forming member is then placed in confronting relationship to the latter member to complete the hollow transparent housing for the greeting card. The ornamental tape or braid can then be applied to the line of juncture between the housing members. If desired, a hook is attached to the top of the housing if the ornament is to be mounted upon a Christmas tree, or a stand may be supplied in the kit for supporting the ornament on a stand in a manner where both sides of the greeting card remain visible from opposite sides of the housing.

Another aspect of the invention deals with the unique construction of the housing. While in certain applications of the invention, the housing may have a transparent side and an opaque side, it is most preferred to utilize an all-transparent housing. The housing-forming members most advantageously have complementary confrontable, narrow neck-forming portions over which an ornamental locking cap forming part of the kit involved is frictionally fittable to lock the housing-forming members together. The confronting surfaces of the housing-forming members, except for possible the neck-forming portions thereof, preferably have interlocking projection and groove-forming portions which loosely frictionally hold the parts together. Removal of the cap permits the housing-forming members to be readily separated in case it is desired to make some changes in the ornamental pieces to be placed within the housing, such as the aforementioned greeting card.

The aforementioned stand may form a spherical seat for the bottom portion of the housing, where the housing is a spherically shaped ball, or may form an aperture adapted to receive the aforementioned capped neck-forming portion thereof. Of course, the orientation of the greeting card or the other ornamental objects fitting within the housing must be such that, when the housing is supported on the stand or hung from a Christmas tree, the ornamental pieces will be right-side-up.

Other aspects of the invention deal with the specific manner in which the aforementioned greeting card is supported within the transparent housing. These and other features, objects and advantages of the invention will become apparent upon making reference to the specification to follow the claims and the drawings.

DESCRIPTION OF EXEMPLARY FORMS OF THE INVENTION SHOWN IN DRAWINGS

Figures 1, 23, 24:
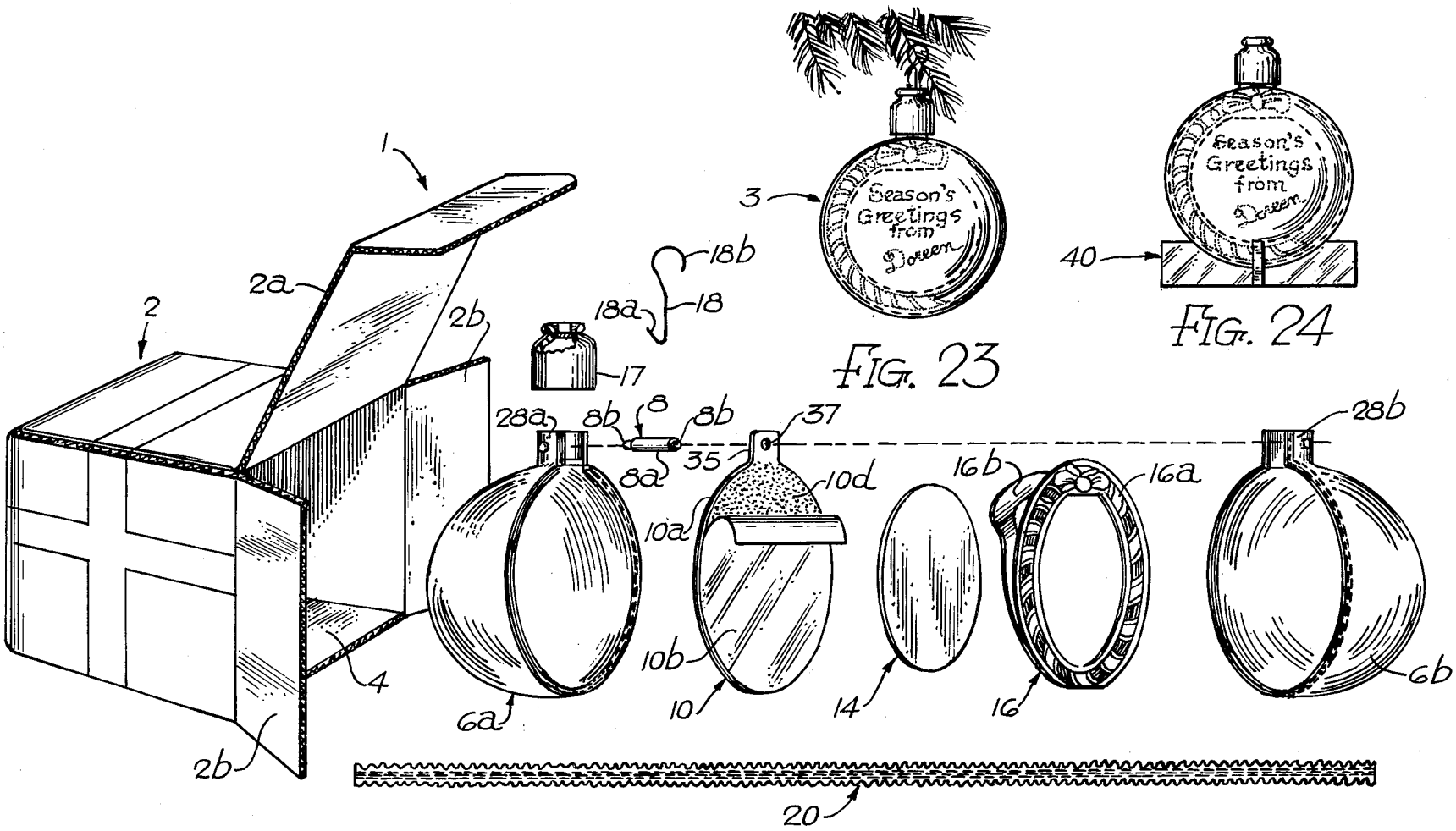
FIG. 1 is an exploded view of a kit for making a personalized Christmas ornament in accordance with one form of the present invention.
FIG. 23 is a view of the assembled ornament shown in FIGS. 19 through 22 supported by a hook member from the branch of a Christmas tree.
FIG. 24 shows the assembled ornament of FIGS. 19 through 22 supported on a stand.
Figure 21:
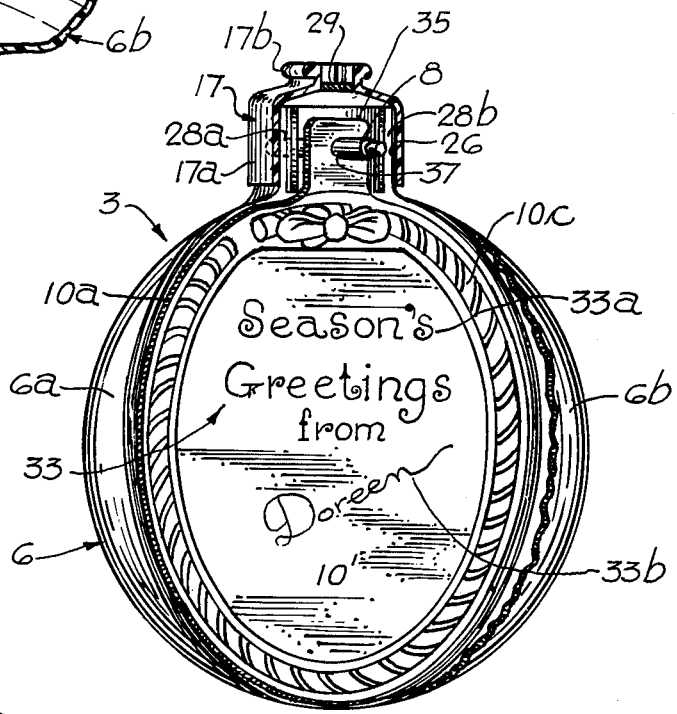
FIG. 21 is a perspective view of the entire assembled ornament shown in FIG. 19 with some of the walls of the housing thereof broken-away to expose the interior of the ornament.
Figure 22:
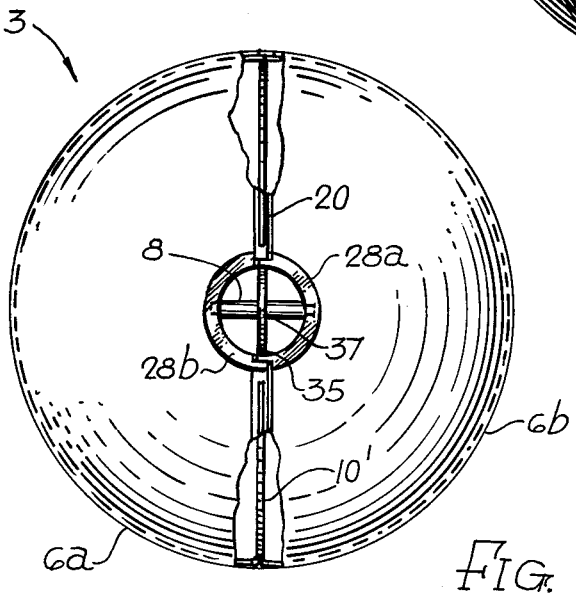
FIG. 22 is a plan view of the assembled ornament of FIGS. 19 through 21 partly broken away.

Refer now more particularly to FIG. 1 which shows the different parts making up a kit 1 for making a personalized Christmas ornament 3 shown in its assembled condition in FIGS. 19 through 24 in accordance with one of the aspects of the invention. The kit most preferably comprises a number of parts which fit into a box, like rectangular box 2 having an opening 4 closable by lateral closure flaps *2b—2b* and an outer closure panel *2a* terminating in a locking tongue *2a'* extendable into the opening 4. The parts of the kit which fit into the box 2 in the most preferred form of the invention include hollow, hemispherical, transparent, housing-forming members *6a—6b* which are preferably snappable into confronting relation along a vertical juncture plane or planes in a manner to be explained, to form a hollow spherical housing 6 (FIG. 21). The kit further includes a hang rod 8 adapted to extend between the upper extremities of the housing-forming members *6a–6b*, a greeting card blank 10 to be hung on the hang rod 8, a template 14 for drawing a cutting line on a photograph to become part of the greeting card, an ornamental border-forming element 16 to fit around the border of the photograph and an ornamental cap 17 for locking the housing-forming members together and forming a point of connection for a hook-forming member 18 also forming part of the kit. The kit also includes an ornamental briad or tape 20 for covering over the exposed line of juncture between the housing-forming members 62–6b.

Refer now more particularly to FIGS. 2 through 7 which illustrate the construction of the hollow hemispherical housing-forming member 6a–6b. The housing-forming members 6a–6b, which may be made of a transparent synthetic plastic material, define hemispherical spaces which, before the members are assembled, open onto the exterior of the same along openings defined by annular flanges 22a–22b. Flange 22a of the housing-forming member 6a is a portion of one half the thickness of the adjacent portion of the housing-forming member and is offset inwardly from the outer surface of the housing-forming member. The flange 22a has a continuous radially facing locking rib 24a projecting outwardly therefrom. The flange 22b of the housing-forming member 6b is about one half the thickness of the adjacent portion of the housing-forming member and is offset outwardly thereof. The flange 22b has an inwardly radially facing groove 24b adapted to receive the locking rib 24a of the other housing-forming member 6a. When the two housing-forming members are pressed into locking confronting relationship, the locking rib 24a resiliently snaps into the groove 22b so as to lightly interlock the housing members together so that the housing members can be readily separated by a small separating force applied to the housing members, permitting an easy disassembly thereof.

The housing-forming members 6a–6b respectively have at their upper ends confrontable semi-cylindrical, neck-forming portions 28a–28b. The semi-cylindrical walls forming these neck portions have respectively centered apertures 32a–32b which are adapted frictionally to receive the reduced end portions 8b—8b of the hang rod 8. The neck-forming portion 28a–28b have oppositely offset portions 30a—30a and 30b—30b which respectively interfit when the housing-forming members are interlocked in the manner explained.

The greeting card blank 10 comprises a main generally circular body portion 10a which may be made of a cardboard-like material having an exposed side 33 containing suitable greeting indicia 33a, such as "Season's Greetings from", centered in the upper portion of the body portion 10a, and a space 33b below the word "from" in which space the sender of the ornament 3 can write in ink his or her name (like "Dorine" shown in FIG. 21). An annular ornamental Christmas wreath 10c is shown printed on or secured to the marginal portions of the side 33 of the main body 10a or the greeting card to form an attractive border for the "Season's Greeting from" marked side thereof. The main body portion of the blank 10 has a vertically projecting tab 35 having an aperture 37 therein adapted to receive the hang rod 8. The other exposed side of the main body portion 10a of the greeting card blank 10 is coated with a suitable pressure sensitive adhesive 10d (FIG. 1) over which a peelable backing sheet 10b is initially applied to cover over the pressure sensitive adhesive 10d. When the backing sheet 10b is peeled from the adhesive 10d, a photograph 38 trimmed to the size of the greeting card blank can be adhesively secured to the blank by the adhesive 10d.

Figures 2, 3, 4, 5, 6, 7, 8, 9, 10, 11, 12, 13, 14, 15, 16, 17, 18:
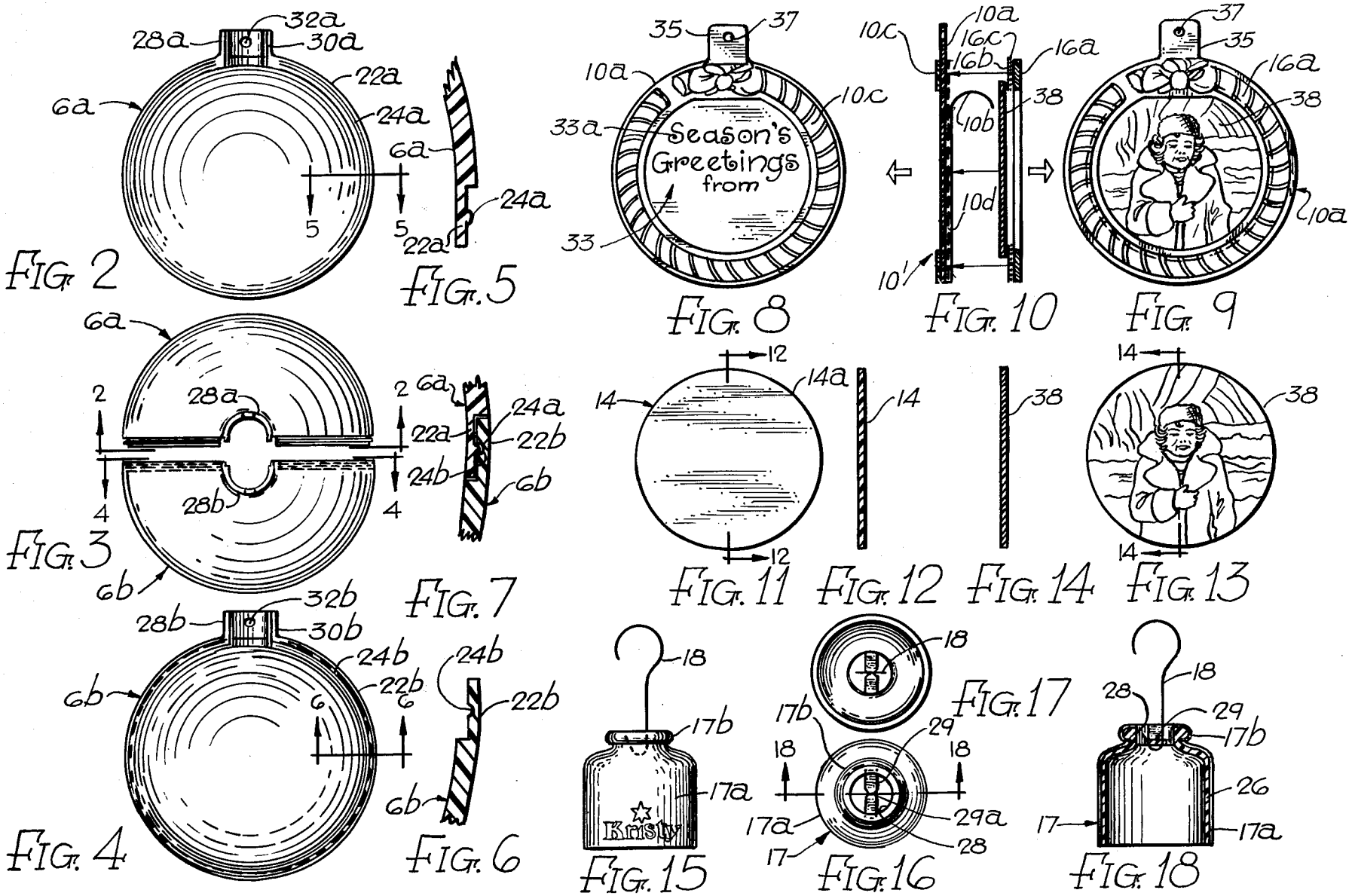
FIG. 2 is a side elevational view of one of the transparent housing members forming part of the kit of FIG. 1, as seen along viewing plane 2—2 in FIG. 3.
FIG. 3 shows both of the transparent housing members of FIG. 1 in spaced contiguous confronting relation.
FIG. 4 is a side elevational view of the other transparent housing member, as seen in viewing plane 4—4 in FIG. 3.
FIGS. 5 and 6 are respectively enlarged fragmentary sectional views through the housing members shown in FIGS. 2 and 4, taken along section lines 5—5 and 6—6 and respectively showing the oppositely offset flanges thereof which are brought into interlocked relation.
FIG. 7 is a view showing the flanges of the housing members in interlocked relationship.
FIG. 8 is a side elevational view of one side of the greeting card blank forming part of the kit of FIG. 1.
FIG. 9 is a view of the greeting card constructed from the greeting card blank shown in FIGS. 1 and 8 after a trimmed-to-size photograph is applied to the other pressure sensitive adhesive-containing side of the blank shown in FIG. 8 and an annular Christmas wreath border-forming element is adhesively secured to the marginal portions of the photograph.
FIG. 10 is an exploded view of the parts making up the greeting card of FIG. 9, namely the greeting card blank, the trimmed-to-size photograph and the Christmas wreath border-forming element.
FIG. 11 is a side elevational view of the template forming part of the kit in FIG. 1, which template is used to place a cutting line upon the photograph, to trim the same to the desired size shown in FIG. 13.
FIG. 12 is a sectional view through the template shown in FIG. 11, taken along section line 12—12.
FIG. 13 is a view of the trimmed-to-size photograph forming part of the greeting card in FIG. 9 before it is applied to the greeting card blank.
FIG. 14 is a sectional view of the photograph shown in FIG. 13, taken along section line 14—14 therein.
FIG. 15 is an elevational view of the ornamental dome or locking cap with attached hook-forming members frictionally fittable over the confronting neck-forming portions of the housing members shown in FIG. 3.
FIG. 16 is a top view of the cap shown in FIG. 15.
FIG. 17 is a bottom view of the cap with attached hook-forming members shown in FIGS. 15 and 16.
FIG. 18 is a vertical sectional view through the cap with attached hook-forming members shown in FIG. 16, taken along section line 18—18 therein.
Figure 19:
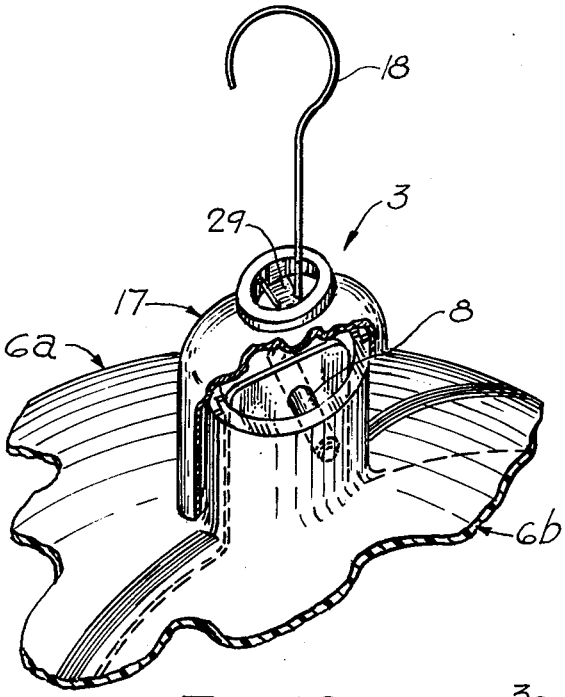
FIG. 19 is an enlarged fragmentary perspective view of the top portion of the assembled ornament made from the kit of FIG. 1 and which shows a hang rod-forming post extending between the neck-forming portions of the housing members and other details of the ornament contiguous thereto.
Figure 20:
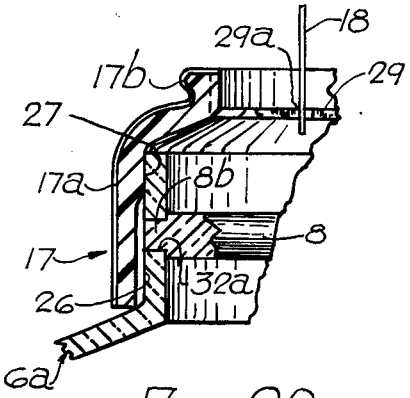
FIG. 20 is an enlarged fragmentary vertical sectional view through the locking cap and neck-forming portions of the assembled ornament.

To enable a photograph to be cut to the desired size to fit on the greeting card blank, the template 14 is provided. The template 14, which may be made from a cardboard-like material or synthetic plastic material, is provided with a circular margin 14a of a size somewhat less than the size of the greeting card blank 10. The template 14 is placed over the photograph involved and a pencil is run along the margin of the template to form a line on the photograph along which the photograph can be cut to the desired size. FIGS. 9 and 10 show the construction of the completed greeting card 10' obtained by applying the photograph 38 over the pressure sensitive adhesive 10d and then applying the annular Christmas wreath border-forming element 16 thereto by removing a backing sheet 16b therefrom to expose a pressure sensitive adhesive layer 16c thereon (FIG. 10) and then applying the adhesive coated side thereof in slightly overlapping relation around the margins of the photograph 38, as shown in FIG. 9.

To assemble the greeting card 10 shown in FIG. 9 within one of the housing-forming members 6a or 6b, first one end of the hang rod 8 is placed within the aperture 32a or 32b in the housing-forming member involved, the pin being held in place either by friction or by the application of adhesive at the reduced end portion 8b thereof, following which the apertured portion 37 of the tab 35 of the completed greeting card 10' is pushed over the hang rod 8. The other housing-forming member is then snapped in place over the first mentioned housing-forming member and, in the process of bringing the housing-forming members together, the previously exposed end 8b of the hang rod will enter the aperture 32a or 32b of said other housing-forming member. The hang rod extends at right angles to the plane of juncture between the housing members and this orients the greeting card so that it is in rough alignment with the line of juncture of the housing-forming members, so that there are unobstructed views of the opposite sides of the greeting card through the transparent housing-forming members 6a–6b.

The hang rod 8 fits within the greeting card 10' aperture 37 so that at most only modest clearances therebetween are present, so that the card cannot pivot into a position where it is so misaligned with this plane that the opposite sides thereof cannot be readily seen through the housing-forming members 6a–6b.

As previously indicated, after the housing-forming members 6a–6b are snapped together, the ornamental locking cap 17 is applied over the confronting neck-forming portions 28a–28b of the housing-forming members. The cap 17, as shown in FIGS. 15–18, includes a main hollow cylindrical body portion 17a which terminates at the upper end thereof in a reduced neck portion 17b. The cylindrical body portion 17a defines a cylindrical space 26, with projecting portions 27 making frictional engagement with the outer cylindrical surfaces of the neck-forming portions 28a–28b of the housing-forming members 6a–6b. The neck portion 17b of the cap 17 has an opening 28 in the top thereof spanned by a horizontal arm 29 having a reduced center portion 29a thereof for receiving the upwardly hooked portion 18a at the bottom of the hook-forming member 18. The upper end of the hook member 18 has a much larger hook 18b for hanging the ornament 3 on the branch of a Christmas tree or the like, as shown in FIG. 23.

The line of juncture between the housing-forming members 6a–6b is preferably covered over by the ornamental braid or tape 20. The braid may be provided with a pressure sensitive adhesive and a pealable backing sheet. However, as illustrated, the ornamental braid 20 has no such adhesive, and it can be applied to the line of juncture between the housing-forming members by lightly applying a suitable liquid adhesive along this line of juncture and applying the braid 20 thereto.

Instead of hanging the completed ornament 3 on a Christmas tree, the ornament may be supported on a stand 40 like that shown in FIGS. 24–27 to which reference should now be made. The stand 40 illustrated is formed from a pair of horizontally elongated leg-forming members 40*a* and 40*b* which may be made of plate-like pieces of synthetic plastic material, like Lucite. The leg-forming members 40*a*–40*b* illustrated respectively have straight horizontal bottom edges 42–42', straight vertical side edges 44—44 and 44'—44', and spaced short horizontal upper edges 46—46 and 46'—46' connected by concave edges 48–48' having a curvature corresponding to the shape of the spherical housing 6. The central portionof the concave upper edge 48 of the stand-forming member 40*a* has a rectangular groove 50 formed therein, and the bottom edge 42' of the leg-forming member 40*b* has a rectangular groove 50' formed therein. The width of the grooves 50–50' is such as to frictionally receive the members 40*b*–40*a* respectively. The depth of the grooves 50–50' is such that when the leg-forming members 40*a*–40*b* are placed at right angles to one another and interlocked so that the portion of the member 40*b* between the groove 50' and the edge 48' is received within the groove 50 of the member 40*a*, and so that the portion of the member 40*a* between the groove 50 and the edge 42 is received within the groove 50' of the other member 40*b*, a stable stand is formed.

Figure 28:
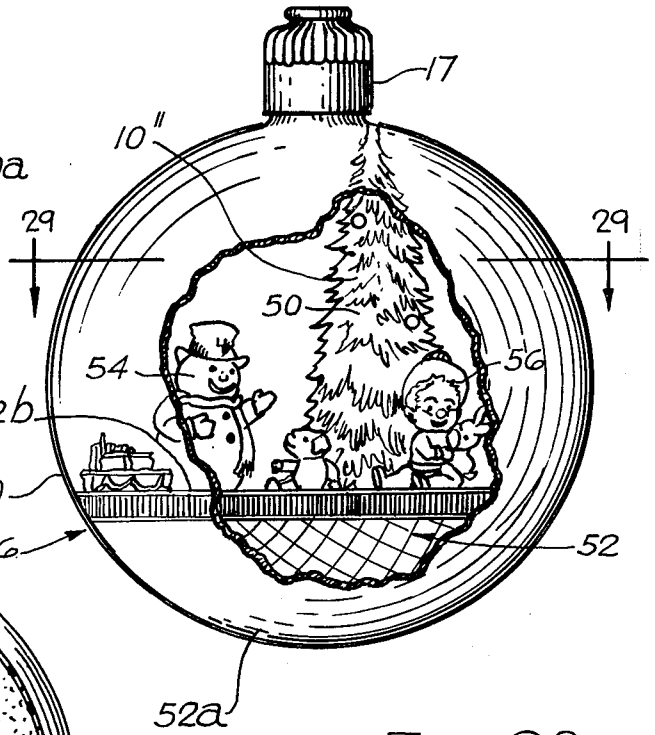
FIG. 28 is a side elevational view, partly broken away, of an ornament constituting another form of the invention wherein the ornament comprises the same housing members and locking cap of the kit shown in FIG. 1 and a three-dimensional Christmas scene-forming unit which replaces the greeting card utilized in the form of the invention shown in FIGS. 1 through 27.
Figure 27:
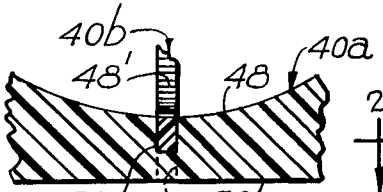
FIG. 27 is a sectional view through the assembled stand shown in FIG. 26, taken along section line 27—27 therein.
Figure 29:
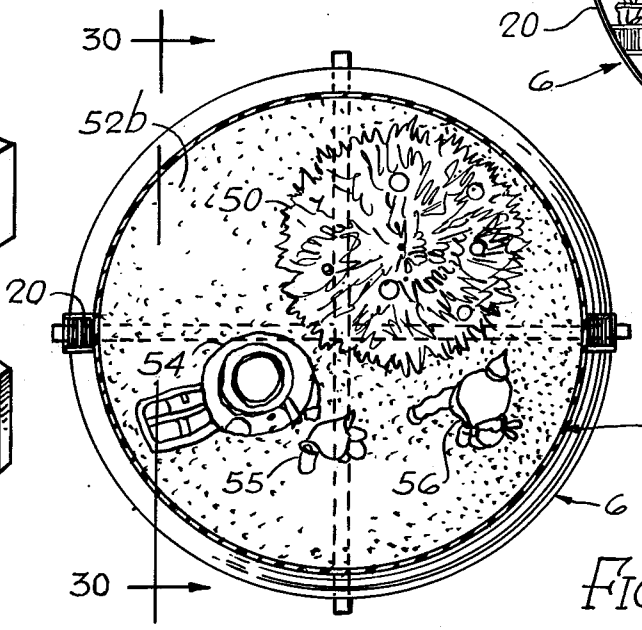
FIG. 29 is a sectional view through the modified ornament of FIG. 28, taken along section line 28—28 thereon.
Figure 25:
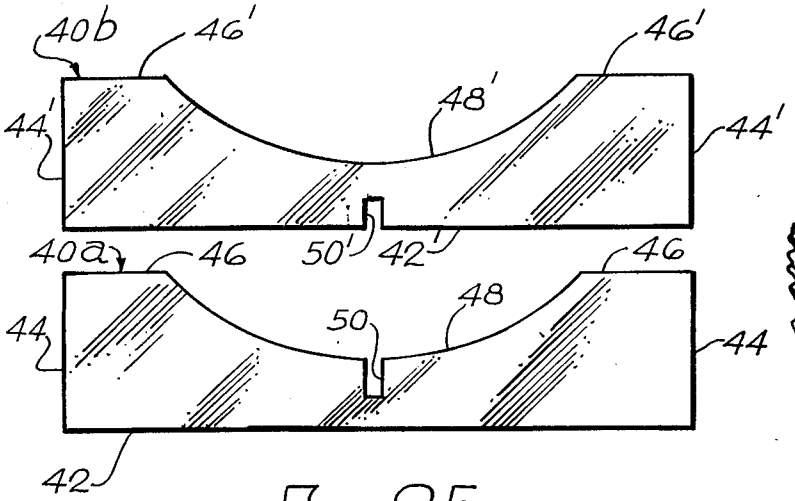
FIG. 25 shows the parts making up the stand shown in FIG. 24 before the parts are assembled to form the stand.
Figure 26:
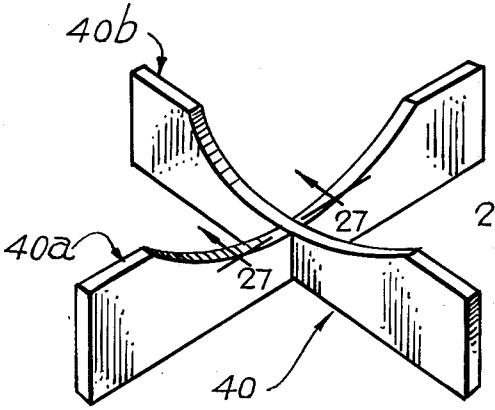
FIG. 26 is a perspective view of the stand formed by the parts shown in FIG. 25.
Figure 30:
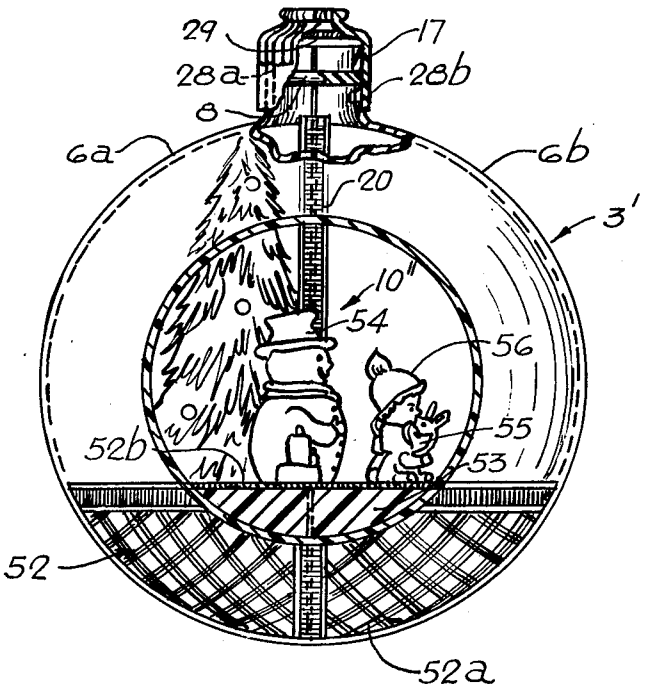
FIG. 30 is a vertical sectional view through the ornament shown in FIG. 28, taken along section line 30—30 therein.

While perhaps the most important form of the present invention is the personalized ornament 3 shown in FIGS. 21–24, ornamental objects other than the greeting card 10' could be mounted within the housing 6 formed by the housing member 6*a*–6*b*. Thus, as shown FIGS. 28–30, to which reference should now be made, the greeting card 10' is replaced by a three-dimensional Christmas scene-forming unit 10'' which is adhesively secured to the bottom portion of the housing interior. This scene-forming unit 10'' is shown as comprising a base portion 52 having a segmental spherically shaped bottom surface 52*a* which substantially fits the curvature of the spherical interior surface of the housing 6 and a flat top surface 52*b* upon which various figurines are mounted, such as a Christmas tree 50 and figures 54–56. The base 52 may be formed from fabric or felt pieces secured over a suitable body 53 made of synthetic plastic material or the like. The Christmas scene-forming unit 10'' may be first adhesively secured within one of the housing-forming members 6*a* or 6*b* following which the other housing-forming member is placed around the same. Then, the cap 17 is applied over the neck-forming portions 28*a*–28*b* of the housing-forming members 6*a*–6*b*.

Figure 31:
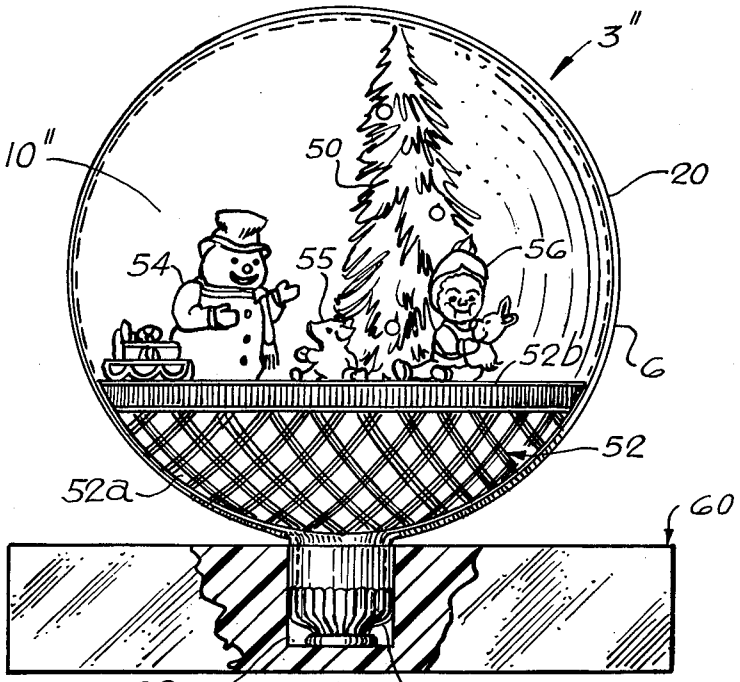
FIG. 31 is a view of still a further modified ornament similar to that shown in FIG. 28 where the scene-forming unit is inverted in position within the housing, the figure further showing the housing mounted with the neck end thereof facing down and extending into a stand.

The ornaments 3 and 3' are primarily designed as Christmas ornaments, hangable on a Christmas tree. However, if one desires to form an ornament which is to be supported at all times on a stand of some kind, then it is preferable to orient the ornamental objects like the greeting card 10' and the scene-forming unit 10'' in a position inverted from that used in ornaments 3 and 3'. Thus, FIG. 31 shows an ornament 3'' made of the identical parts shown in FIGS. 28–30 except that the Christmas scene-forming unit 10'' is mounted in the end of the housing members contiguous to the neck-forming portions thereof. In such case, the neck-forming portions 28*a*–28*b* of the housing-forming members 6*a*–6*b* project downwardly from the housing 6 and a stand 60 is provided for receiving the neck-forming portions 28*a*–28*b* of the housing 6. To this end, the stand 60 may be a block of synthetic plastic material, such as Lucite, having a recess 62 in the upper portion thereof adapted to receive the capped neck-forming portions 28*a*–28*b* of the housing 6.

The various forms of the present invention have thus provided attractive and rugged figurine-containing ornaments mountable on a Christmas tree and/or a stand, and which can be made in a simple and easy manner from parts sold in kit form. It should be understood that numerous modifications can be made in the preferred form of the invention described without deviating from the broader aspects of the invention.

I claim:

1. A kit for making an ornament comprising in combination: a pair of housing-forming members each open along a side thereof and interlockable into confronting relation along their open sides to form a housing enclosure therebetween, said housing-forming members having complementary confrontable narrow neck-forming portions which extend upwardly from the respective housing-forming members, at least one of said members having a transparent portion enabling the interior of the resulting housing to be viewed, hang rod-forming means extending or extendable between said confronting narrow neck-forming portions, and an ornamental article mountable in a given predetermined position in said housing so as to be visible through said transparent portion of at least said one housing-forming member, said ornamental article having means adapted to receive and make hanging engagement with said rod-forming means.

2. The kit of claim 1 wherein said housing-forming members are both transparent and lockable in confronting relation along a vertical juncture plane or planes to provide substantially unobstructed horizontally extending fields of view into the housing on opposite sides of said vertical juncture plane or planes, and said ornamental article is on said rod-forming means supportable in a vertical position in rough alignment with said juncture plane or planes of said housing-forming members.

3. The kit of claim 1 wherein said confronting narrow neck-forming portions are held together by a locking cap frictionally fitting over said neck-forming portions.

4. The kit of claim 1 wherein there is provided a hook-forming member for hanging said housing from a Christmas tree.

5. The kit of claim 1 wherein both of said housing-forming members are transparent, enabling the interior thereof to be viewed from opposite sides thereof, and said ornamental article is a greeting card blank where both sides thereof are visible clearly from said opposite sides of said housing, said greeting card blank having greeting card indicia visible on one side thereof, the opposite side of said greeting card blank having a pressure sensitive adhesive thereon for holding a photograph thereon, and a peelable backing sheet covering said adhesive layer.

6. The kit of claim 5 wherein there is further provided a template along portions of which a pencil can trace the outline thereof upon said photograph or the like to be placed upon said greeting card blank.

7. The kit of claim 5 wherein said kit also is provided with an ornamental border-forming element securable in overlapping relationship with the border portion of the photograph or the like to be secured to said greeting card blank.

8. The kit of claim 7 provided with an ornamental braid for covering the exposed line or lines of juncture between said housing-forming members.

9. An ornament comprising, in combination: a pair of housing-forming members each open along a side thereof and interlocked into confronting relation along their open side to form a housing enclosure therebetween, said housing-forming members having complementary confronting narrow neck-forming portions which extend upwardly from the housing-forming members, at least one of said members having a transparent portion enabling the interior of the resulting housing to be viewed, rod-forming means extending between said confronting narrow neck-forming portions, and an ornamental article mounted on said rod-forming means in a given predetermined position in said housing so to be visible through said transparent portion of at least said one housing-forming member, said ornamental article having means receiving said rod-forming means.

10. The ornament of claim 9 wherein said housing-forming members are both transparent and interlocked in confronting relation along a vertical juncture plane or planes to provide substantially unobstructed horizontally extending fields of view into the housing on opposite sides of said vertical juncture plane or planes, and said ornamental article is supported in a vertical position in rough alignment with said juncture plane or planes of said housing-forming members.

11. The ornament of claim 9 wherein said confronting narrow neck-forming portions are held together by a locking cap frictionally fitting over said neck-forming portions.

12. The ornament of claim 11 wherein there is provided a hook-forming member on said locking cap for hanging said ornament from a Christmas tree.

* * * * *